United States Patent [19]

Balbo et al.

[11] Patent Number: 4,991,490

[45] Date of Patent: Feb. 12, 1991

[54] BREECH WEDGE FOR ARTILLERY CANNON

[75] Inventors: Patrick Balbo; Robert Vernet, both of Bourges, France

[73] Assignee: Etat Francais-Delegue General pour l'Armement, Paris, France

[21] Appl. No.: 285,065

[22] Filed: Dec. 16, 1988

[30] Foreign Application Priority Data

Dec. 17, 1987 [FR] France ..... 87 17620

[51] Int. Cl.[5] ..... F41A 3/10

[52] U.S. Cl. ..... 89/24

[58] Field of Search ..... 89/24; 42/14

[56] References Cited

U.S. PATENT DOCUMENTS

| | | | |
|---|---|---|---|
| 447,376 | 3/1891 | Sponsel | 89/24 |
| 2,353,816 | 7/1944 | Dodge et al. | 89/24 |
| 2,465,271 | 3/1949 | Ruau | 89/24 |
| 3,951,041 | 4/1976 | Bartolles | 89/24 |
| 4,558,626 | 12/1985 | Bartolles | 89/24 |

FOREIGN PATENT DOCUMENTS

| | | | |
|---|---|---|---|
| 9233 | 7/1900 | Denmark | 89/24 |
| 442119 | 8/1912 | France | 89/24 |
| 2464451 | 3/1981 | France | 89/24 |
| 1223 | of 1905 | United Kingdom | 89/24 |

*Primary Examiner*—Charles T. Jordan
*Assistant Examiner*—Stephen Johnson
*Attorney, Agent, or Firm*—Parkhust, Wendel & Rossi

[57] ABSTRACT

The invention relates to a breech wedge for artillery cannon, of a type that includes means for supporting a primer-cartridge magazine that is driven in translation and rotation under the control of an assembly consisting of a rack and pinion. This first pinion is mounted on a shaft supporting a second pinion, which cooperates with a second rack integral with a fork sliding on the wedge. A control lever pivots on the breech sleeve and supports a roller, which cooperates with a groove in the fork in such a way as to slide the fork on the breech wedge. A second roller cooperates with a groove in the wedge in such a way as to cause the wedge to slide on the breech sleeve.

8 Claims, 10 Drawing Sheets

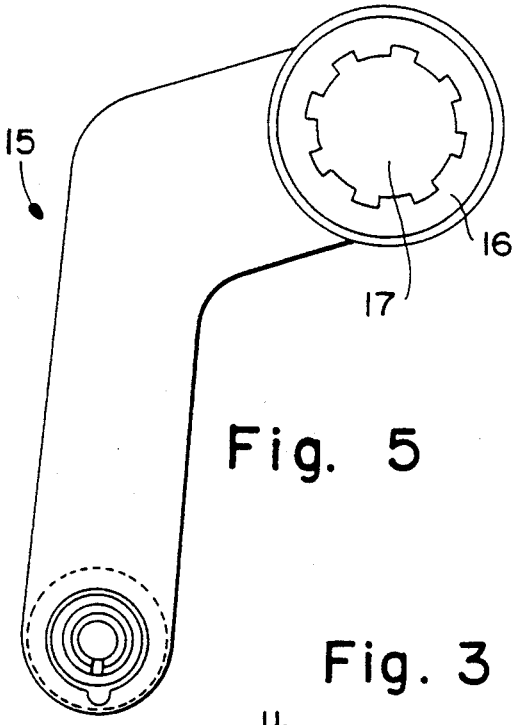
Fig. 5
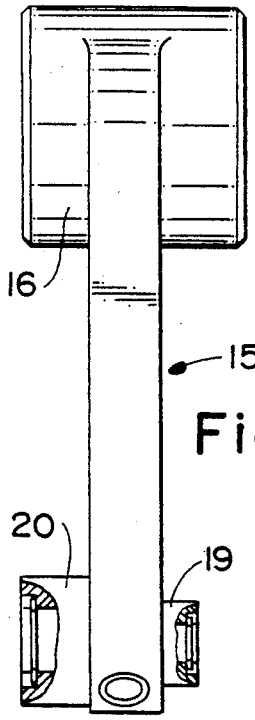
Fig. 6
Fig. 3
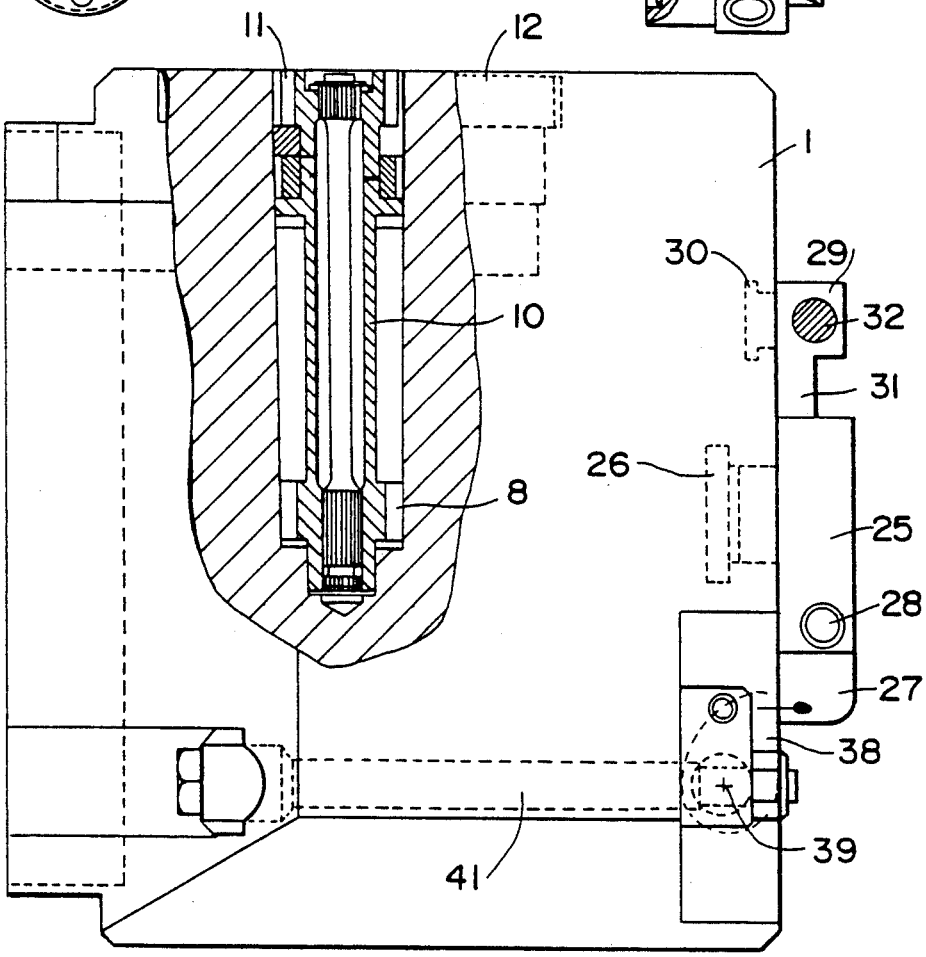

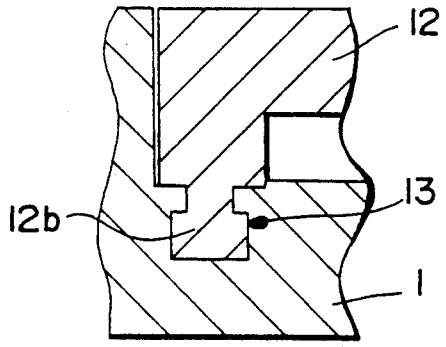
Fig. 4c
Fig. 4d
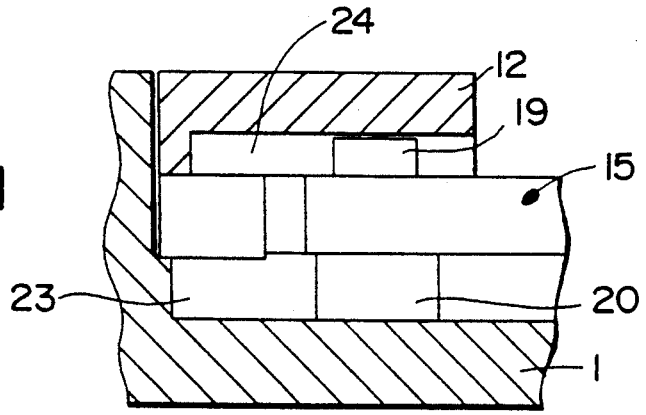
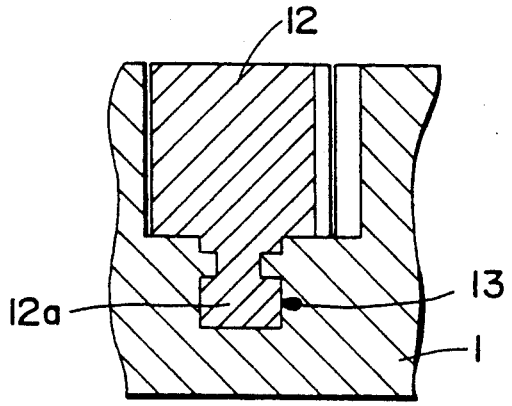
Fig. 4e

BREECH WEDGE FOR ARTILLERY CANNON

BACKGROUND OF THE INVENTION

1. Field of the Invention

The present invention relates to the field of artillery breech wedges, and more particularly those of the type including means to support a primer-cartridge magazine that is driven in translation and rotation by a rack and pinion assembly.

2. Description of the Prior Art

Such breech wedges are used in cannons that fire ammunition comprising a projectile and a propulsive charge, contained either in a power bag or a combustible shell. The charge is fired by a primer placed in a chamber in the rear of the breech wedge and communicating through a straight, narrow channel with the propulsive charge placed in the breech opening. To increase the firing rate, the primers are mounted on revolving magazines that bring a new unspent primer into the chamber with each shot fired.

The French patent No. 2.464.451 describes a breech wedge of the type mentioned above. The rack and pinion assembly is actuated by a lever integral with the pinion and a cam integral with the weapon recoil slides. Also in this document, the pin is carried on a slider that slides on the breech wedge, butting up against the sleeve in the firing position, or releasing the primer-cartridge magazine when open, with a set of grooves arranged in a tee and inclined with respect to the direction of motion of the wedge. Lastly, the narrow channel is inclined and is relatively long and does not reach the center of the firing plate.

The breech wedge of FR '451 will now be explained in greater detail.

In FIG. 7, the axis XX' of the gun tube of FR '451 has been represented, as well as the chock of the breech 1 and a part of the handle of this breech in which the chock slides on surfaces 53a and 53b which are visible in the figure. Perforations 54 with axis YY', which is called the ignition conduit, is provided in the breech chock 51. This pipe opens at one end of the firing breech of gun 55 and at the other extremity towards the detonator breech 56.

The device according to FR '451 detonator support 57 with a circular form, as represented in detail in FIG. 10, which holds n detonators 58. The number of detonators, in this particular example of implementation has been selected to be equal to 12 for reasons of available space. It is naturally clear that this number can be increased or reduced on the basis of the available space to house the device in the breech. Detonators 58 are mounted on the detonator support in such a manner that their axes are parallel with the YY' axis of ignition conduit 54, with one detonator being located in the detonator chock 56, while the others are placed in housing 9 provided in the breech chock. During a change of detonator, the detonator support must be able to rotate so as to bring an unfired detonator into the detonator breech. To achieve this, the detonator support must perform a stepwise rotational movement around axis ZZ' which is parallel to the ignition conduit. This stepwise rotation occurs during the translational motion of the detonator support along the axis ZZ', which is achieved by the couple comprising striking pin 60 with axis 60a and rack 61. Rotation is achieved when the detonators have left housings 59 and breech 56. The rack can slide along axis ZZ', it is an integral part of detonator support 57, and it is activated by a striking pin 60 which is an integral part of lever 62 controlled during the opening of the gun breech. Rack 61 is a circular rack used to permit the simultaneous rotational and translational motion of the detonator-support.

The rotational motion of the detonator-support of FR '541 is achieved by grooves 63a and 63b provided in shaft 64 (represented in FIGS. 11 and 12) which work in cooperation with grooves 65 of grooved ring 66 (represented in FIGS. 13 and 14). The grooved shaft possesses, along its generating lines, two assemblies 63a and 63b of male grooves, which two assemblies are separated by a distance D and shifted by $\pi/n$. The number of grooves of the two assemblies must be equal to the number of detonators placed on the detonator-support. These grooves are fitted with bevels 67a and 67b with an angel $\alpha$ with respect to the generating lines of the shaft, and forming between themselves an angle of $(\pi-2\alpha)$. The grooved ring comprises n female grooves 68 (represented in FIG. 14) which can slide along the male grooves 63a or 63b of shaft 64. The height of the ring is slightly larger than the distance D, so that the shaft is always engaged on the ring. The extremities of the male grooves 65 formed between the female grooves of the ring are fitted with bevels 69 at the same angle $\alpha$ as those provided on the shaft, and forming between themselves an angle of $(\pi-2\alpha)$.

The grooved ring 66 of FR '451 is integrally connected to the breech chock by nut 70 and tongue 71 held in groove 73 of the breech chock.

The detonator-support of FR '451, as shown in FIG. 10, consists of two disk-shaped parts 74 and 75, which are integrally connected by screw 76 and positioning pin 77. The back bottoms 78 of the detonators are held between the two parts 74 and 75. The assembly formed in this manner is integrally connected to grooved shaft 64 through the intermediary of a plug 79, for example, with a hexagonal shape, and by pin 80. One variant of FR '451 consists in immersing the bottoms of the detonators in a block, for example, made of plastic material, whose function is to replace parts 74 and 75, as well as screw 76 and finger pin 77. In both cases, the detonator-support assembly constitutes a means which can easily be disassembled and which permits the rapid change of detonator-supports.

Disk-shaped part 74 of FR '451 also comprises holes 81 which are aligned with the axes of the detonators and which permit the passage of the striking pin 82 which is housed in the striking pin support breech 83, and which also rests against surface 85 of the detonator-support when the breech chock is closed. The striking pin 82 is kept in the retracted position by spring 86 which is kept in place by screw 87 and activated at the appropriate time by an adjoining device which is not represented because it can be easily imagined by the expert.

The detonator-support chock 83 of FR '451 is maintained on the breech chock by a set of slide guides 88 and it is subjected to the action of spring 89, which is limited by abutment 90 attached to the breech chock. A second set of slide guides 91a and 91b, placed on the striking pin support breech and the breech ring, respectively, allows the striking pin support breech to disengage the detonator-support in order to permit its recoil movement. After completion of a pathway, slide guides 91a and 91b are uncoupled, with the striking pin support breech is now kept against abutment 90 (see FIG. 8).

The operation of the device according to FR '451 is described below. The breech chock i closed (see FIG. 7), the striking pin 82 is activated and it ignites detonators 58 which, through the intermediary of channel 54, ignites the ammunition placed in chock 55 of the gun. After firing, the breech chock is opened (see FIG. 8); the striking pin support breech is entrained by its slide guides 91a and it disengages the detonator-support. During this phase, lever 62 is automatically activated and it entrains pin 60 as well as circular rack 61 and shaft 6 which moves in grooved ring 66. At a predetermined position, bevels 68b and 69 come in contact (see FIG. 16) and they rotate shaft 64 by $\pi/n$. Next, the new ammunition is placed in the gun breech and the breech chock is closed. At the same time, lever 62 is activated, bevels 67a and 69 come in contact (see FIG. 15), and rotate the shaft by $\pi/n$. The total rotation of $2\pi/n$ achieved thus has permitted the placing of a new detonator in position. The striking pin support breech is placed in a position on the detonator-support and a new spot can be fired.

Although this breech wedge is generally satisfactory, it does have certain disadvantages. Firstly, there are many moving parts and the slider sliding system calls for delicate machining. Also, the asymmetrical ignition generates pressure peaks that cause ballistic dispersion.

The present invention aims to remedy these disadvantages by providing a breech wedge in which the magazine movements are controlled directly by the translational motion of the wedge, without requiring any external mechanical parts. The invention also attempts to simplify the primer securing and firing mechanism.

SUMMARY OF THE INVENTION

Accordingly, the invention is for a breech wedge for artillery canon, of the type that includes means for supporting a primer-cartridge magazine, the translational and rotational motion of which is controlled by a system consisting of a rack and pinion. The pinion is mounted on a shaft supporting a second pinion arranged to cooperate with a second rack integral with a fork sliding on the wedge. A control lever pivoting on the breech sleeve supports a roller that cooperates with a groove in the fork, causing the fork to slide on the breech wedge, and a second roller cooperating with a groove in the wedge causes the wedge to slide on the breech sleeve.

So the same lever that opens and closes the breech also rotates the primer-cartridge magazine.

The second groove may in particular have a circular part centered on the axis of rotation of the control lever, so that the breech wedge remains roughly stationary with respect to the breech sleeve as the primer-cartridge magazine rotates.

The two rollers can be mounted coaxially on the control levers with the grooves in the fork and in the breech wedge, through which the rollers ride as the wedge slides on the breech sleeve, are superposed when the fork is in the position where the primer-cartridge magazine is engaged in the breech wedge.

In one particular arrangement in accordance with the invention, the breech wedge has a slider that carries the pin and is mounted on the wedge. It slides between one position where the pin is facing a primer ready to be fired, and a second position where the slider frees the primer-cartridge magazine. Stops are then provided on the breech sleeve to cause the slider to move with respect to the wedge when the wedge moves with respect to the sleeve.

More particularly, the slider may be integral in its translational motion with a rod sliding in a bore in the breech sleeve, with one rod stop cooperating with a sleeve stop to drive the slider to its first position when the breech is sealed, and a stop on the slider cooperating with another on the sleeve to drive the slider to its second position when the breech is open.

The slider may advantageously include an inclined surface to cooperate with a corresponding surface on the primer-cartridge magazine, to crimp the primer into its opening. The resulting translational motion for the first rack is absorbed by a torsional prestress in the shaft supporting the first and second pinions.

The component actuating the breech wedge pin according to the invention may in particular be mounted pivoting on the wedge at a position such that it is not possible to actuate the pin unless the slider is in its first position.

As the firing component is mounted on the breech sleeve, when the breech is open the firing system alignment is broken at two points: first between the breech sleeve and the breech wedge and then between the breech wedge and the pin carriage slider.

BRIEF DESCRIPTION OF THE DRAWING

A better understanding of the present invention may be had from a consideration of the following detailed description of one mode of construction, taken in conjunction with the accompanying drawing in which:

FIG. 3 is an elevation view from the left, of a partial section along the line III—III in FIG. 1;

FIGS. 4*c*–4*e* are partial cross-sectional views taken along lines 4*c*—4*c*, 4*d*—4*d* and 4*e*—4*e* of FIG. 4*b;*

FIG. 5 is a top view of the control lever; and

FIG. 6 is a partial cross-sectional side view of this lever.

Figure 1:
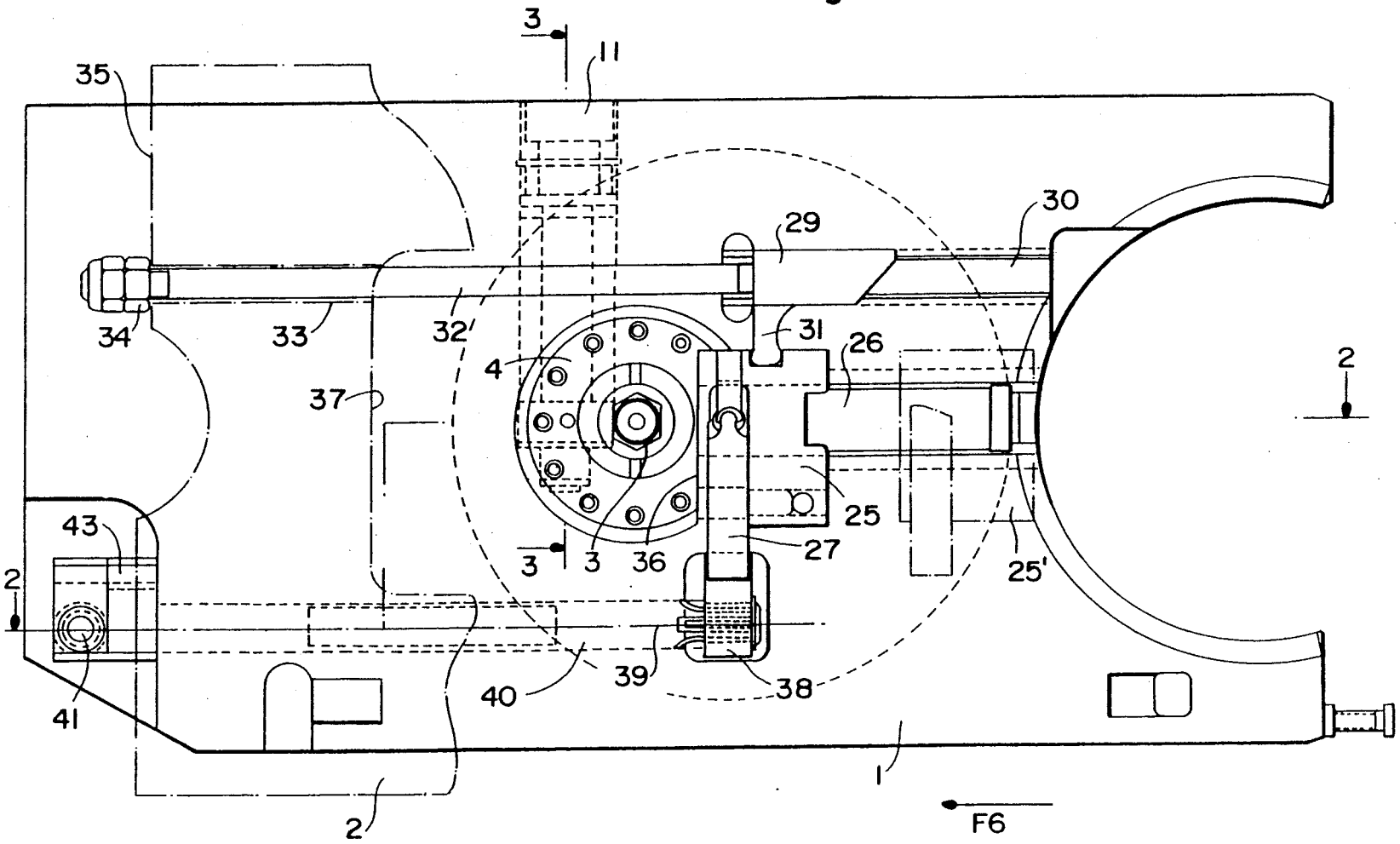
FIG. 1 is a rear view of the breech wedge according to the invention.

The bridge wedge 1 is mounted in a fashion, sliding on the breech sleeve 2, partly shown in dashed-dotted lines in FIG. 1.

A mounting system 3 supports a primer-cartridge magazine 4 such that a primer is positioned in a primer-cartridge chamber 6 communicating with the weapon barrel through a narrow, straight channel 7.

A pinion 8 and rack 9 back the primer-cartridge magazine off from the channel and pivot it each time a shot is fired.

Such an arrangement is described in French patent No. A 2,464,451, mentioned above. We will nonetheless point out that, in the breech wedge according to the present invention, the narrow, straight channel extends along the axis of the weapon tube.

In the present case, the pinion 8 is mounted at the lower end of a torsion shaft 10 supporting another pinion 11 (FIG. 3) at its upper end. This shaft 10 is mounted to rotate in the breech wedge 1, under a prestress, tending to return the rack 9 to the rear.

Figure 4A:
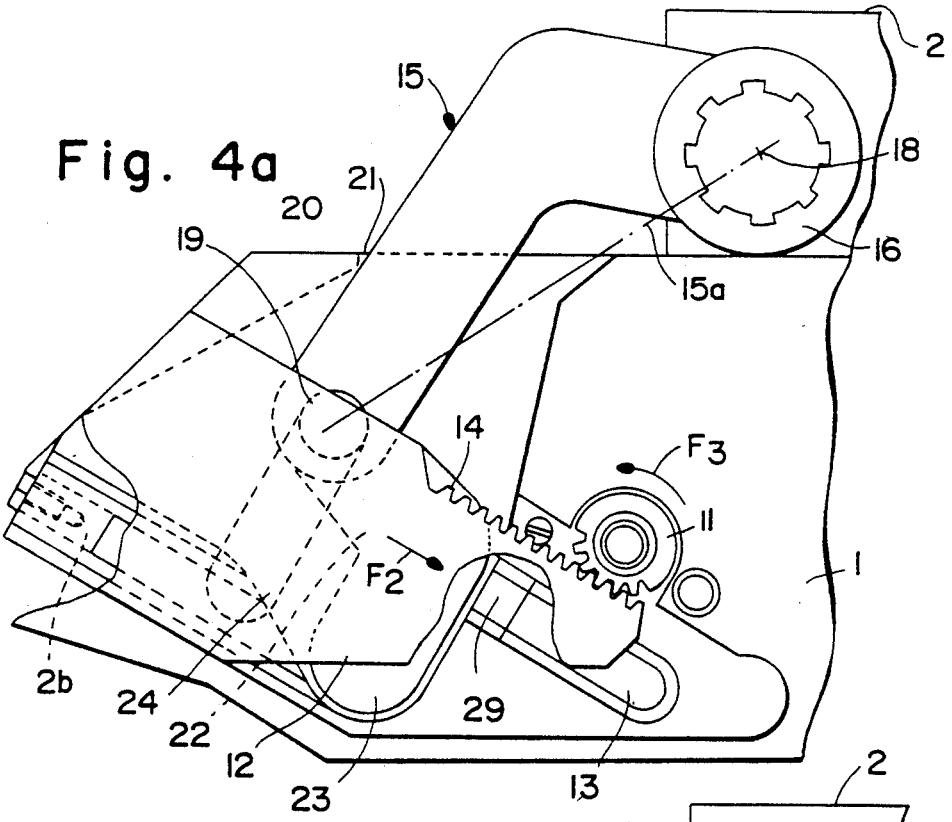
FIGS. 4*a* and 4*b* are partial top views with the fork at two positions.
Figure 4B:
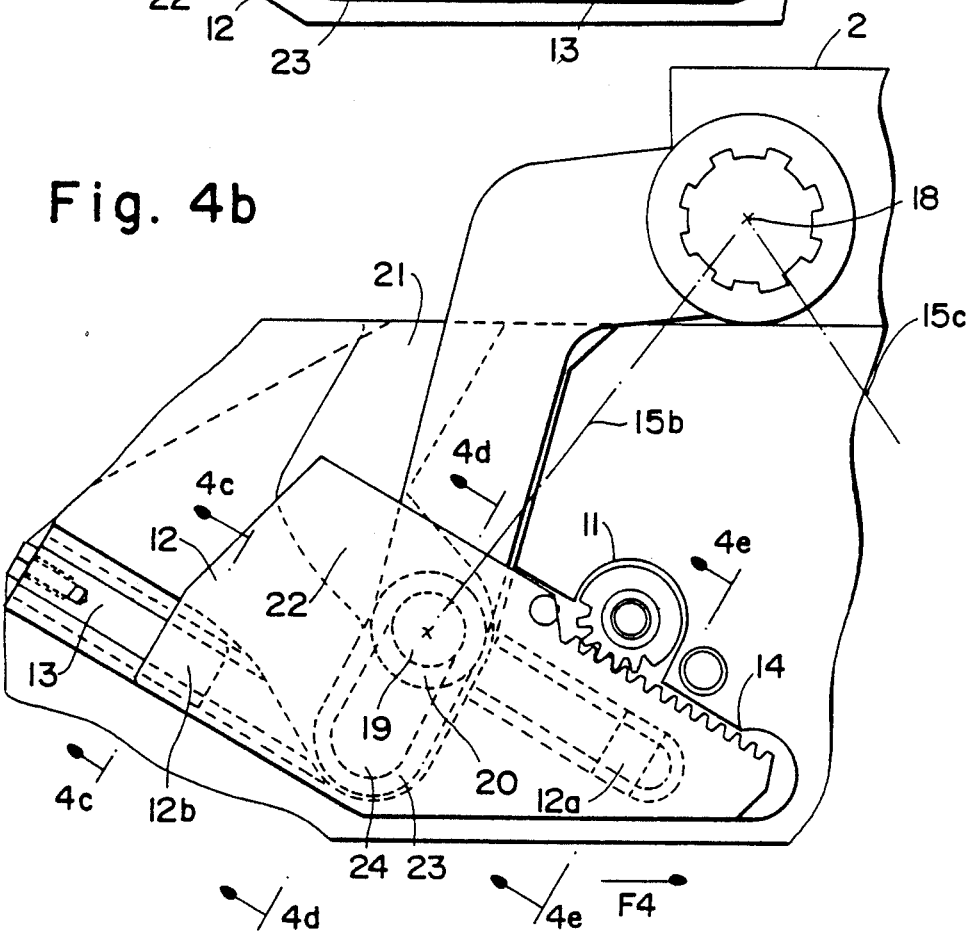

On its upper part, as shown in FIGS. 4*a* and 4*b*, the breech wedge 1 supports a fork 12. The fork 12 is located in a recess of similar shape (not shown in FIG. 1 to simplify the drawing) in the upper surface of the breech wedge 1 to allow the breech wedge 1 to slide in relation to the breech sleeve 2 without obstruction. Two splines 12*a* and 12*b*, located on the lower surface of the fork 12, fit into two sets of tee shaped grooves 13 which are further recessed in the upper surface of the breech wedge 1. This configuration allows the fork 12 to slide in the direction of the tee shaped grooves 13 along the upper surface of the breech wedge 1.

The fork 12 also includes a rack 14 arranged to cooperate with the pinion 11.

The sliding motion of the fork 12 with respect to the breech wedge 1 is controlled by a lever 15 shown in detail in FIGS. 5 and 6 and diagrammed in three different positions by the mixed lines 15*a*, 15*b* and 15*c* of FIGS. 4*a* and 4*b*.

One end of the lever 15 includes a socket 16 with an internal splined bore 17 capable of cooperating with a corresponding channeled shaft mounted in rotation on the breech sleeve. Only the centerline 18 of this shaft is shown in FIGS. 4*a* and 4*b*.

The lever 15 also carries two coaxial roller 19 and 20 on its other end.

The roller 20 is fitted into a Z-shaped groove in the breech wedge 1 including on rectilinear part 21, one circular part 22 centered on the 18 and a second rectilinear part 23.

The roller 19 is fitted in a rectilinear groove 24 of the fork 12.

In the position of FIG. 4*b*, part 23 of the Z groove and groove 24 are superposed.

Breech wedge 1 also supports a slider 25 riding in tee grooves 26. The pin 27 pivots on the shaft 28 (FIG. 3) of slider 25.

A slide 29 also slides on the breech wedge 1 in tee grooves 30 and is made integral with the slider 25 by a protruding element 31. The slide 29 is also integral with a rod 32 sliding in a bore 33 of the breech sleeve 2.

The rod 32 carries a nut 34 on its end opposite the slide 29. This nut serves as a stop, to cooperate with a stop surface 35 on the breech sleeve 2.

A pin actuating element 38 is mounted pivoting on the breech wedge about a shaft 39. The element 38 is integral in rotation with a shaft 40.

A rod 41 is mounted in a bore in the breech wedge 1 to move translationally against the action of a spring 42. A cam 43 converts this translational motion of rod 41 into a rotational motion for shaft 40, hence operating the pin actuating element 38.

When the breech wedge is in its open position, shown in FIG. 4*a* with the lever 15 in its position 15*a*, this lever is rotated in the direction of the arrow F1 while the roller 20 moves through the part 22 of the Z-shaped groove.

The roller 19 cooperating with the groove 24 therefore causes the fork 12 to move with respect to the breech wedge 1 in the direction of the arrow F2. This movement causes pinion 11 to rotate in the direction of the arrow F3, by means of the rack 14. The shaft 10 and pinion 8 are then rotated and they, by means of the rack 9, place a primer in the chamber 6 by a known method as described in the abovementioned French patent No. A 2,464,451.

Figure 2:
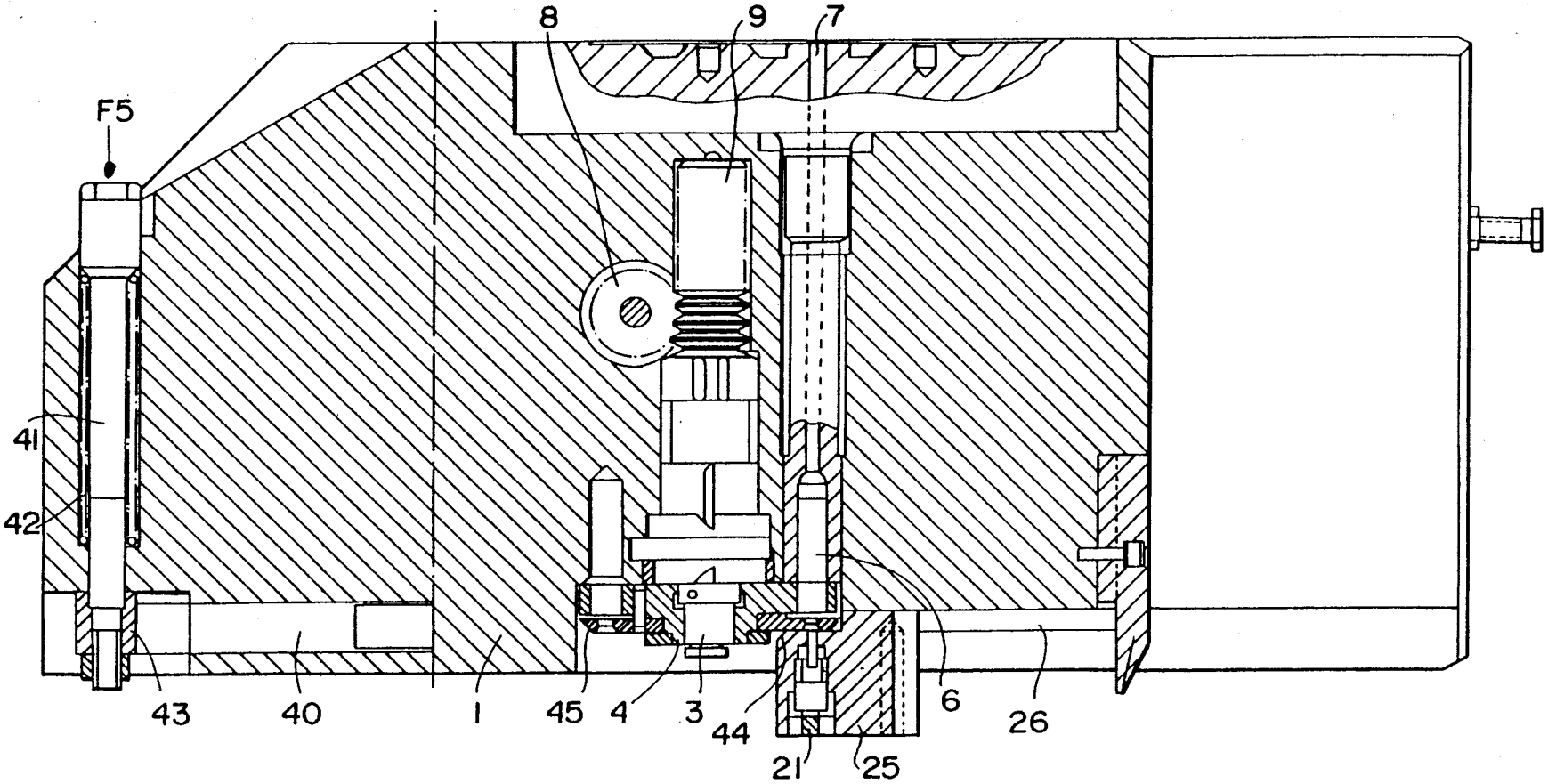
FIG. 2 is a cross section along the line II—II in FIG. 1.
Figure 7:
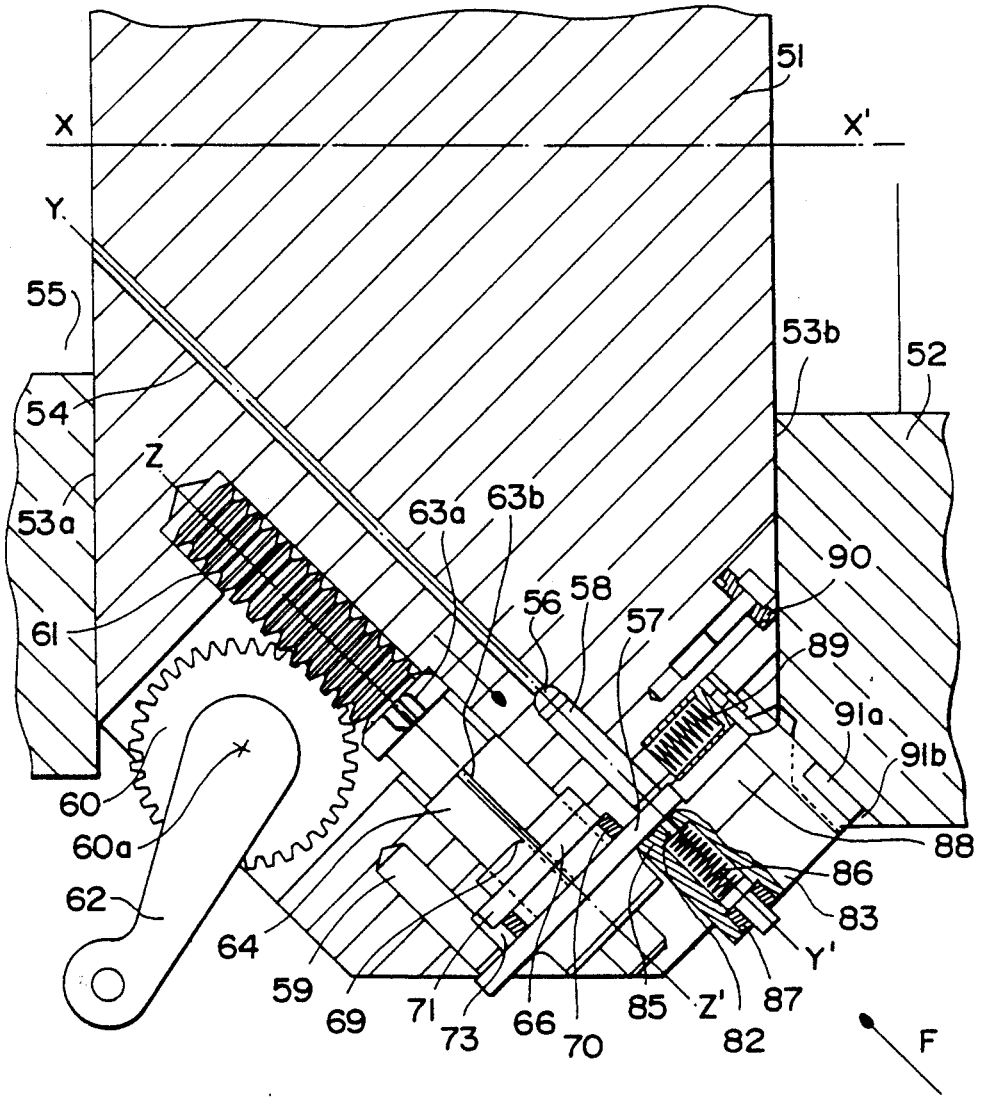
Fig. 7 PRIOR ART
FIG. 7 represents a cross section through the FR '451 device in the closed position, passing through the axis of the cannon tube and the axis of the detonator-support.
Figure 8:
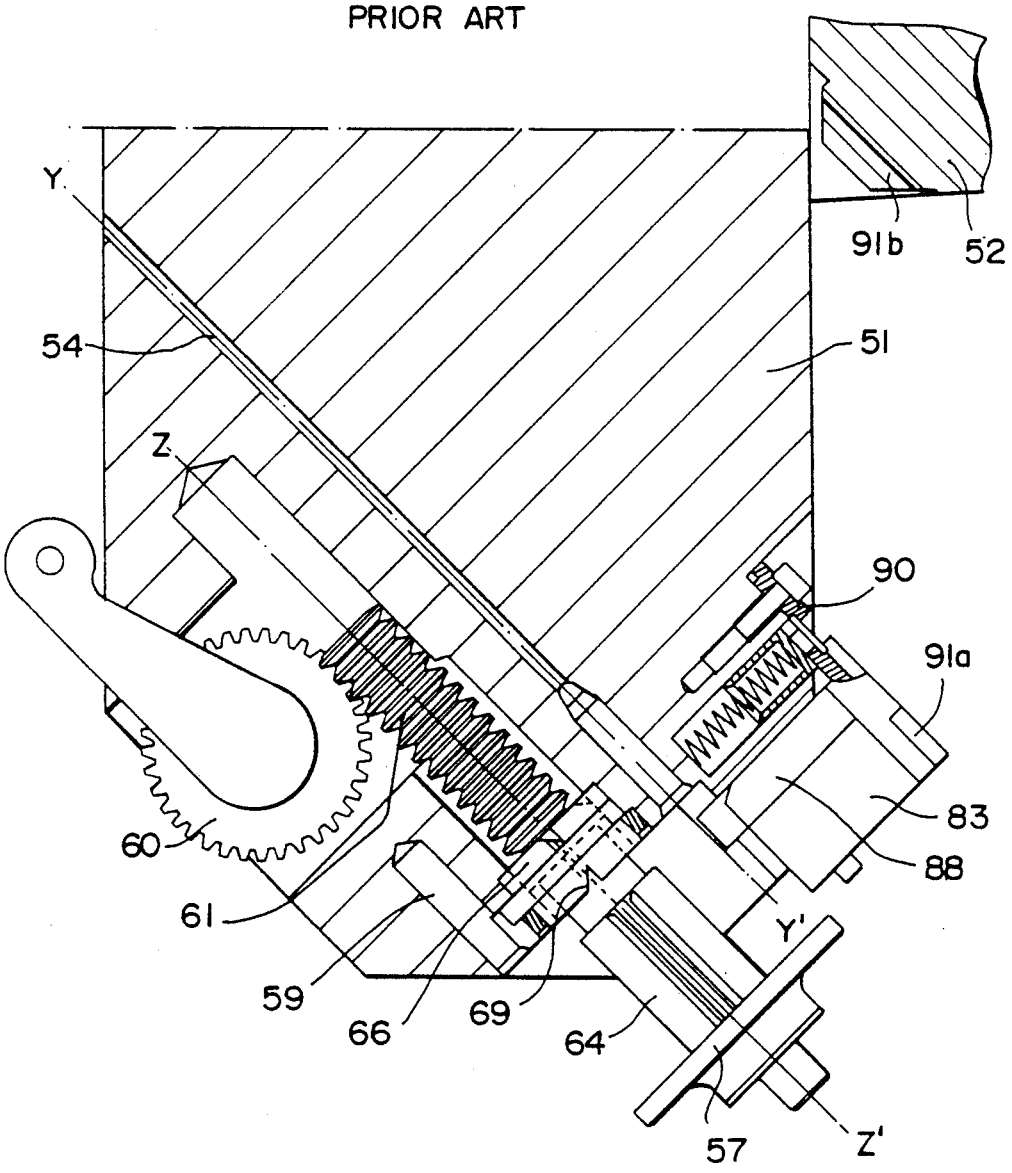
Fig. 8 PRIOR ART
FIG. 8 represents the same section as that of FIG. 7, with the FR '451 feed device in the open position.
Figure 9:
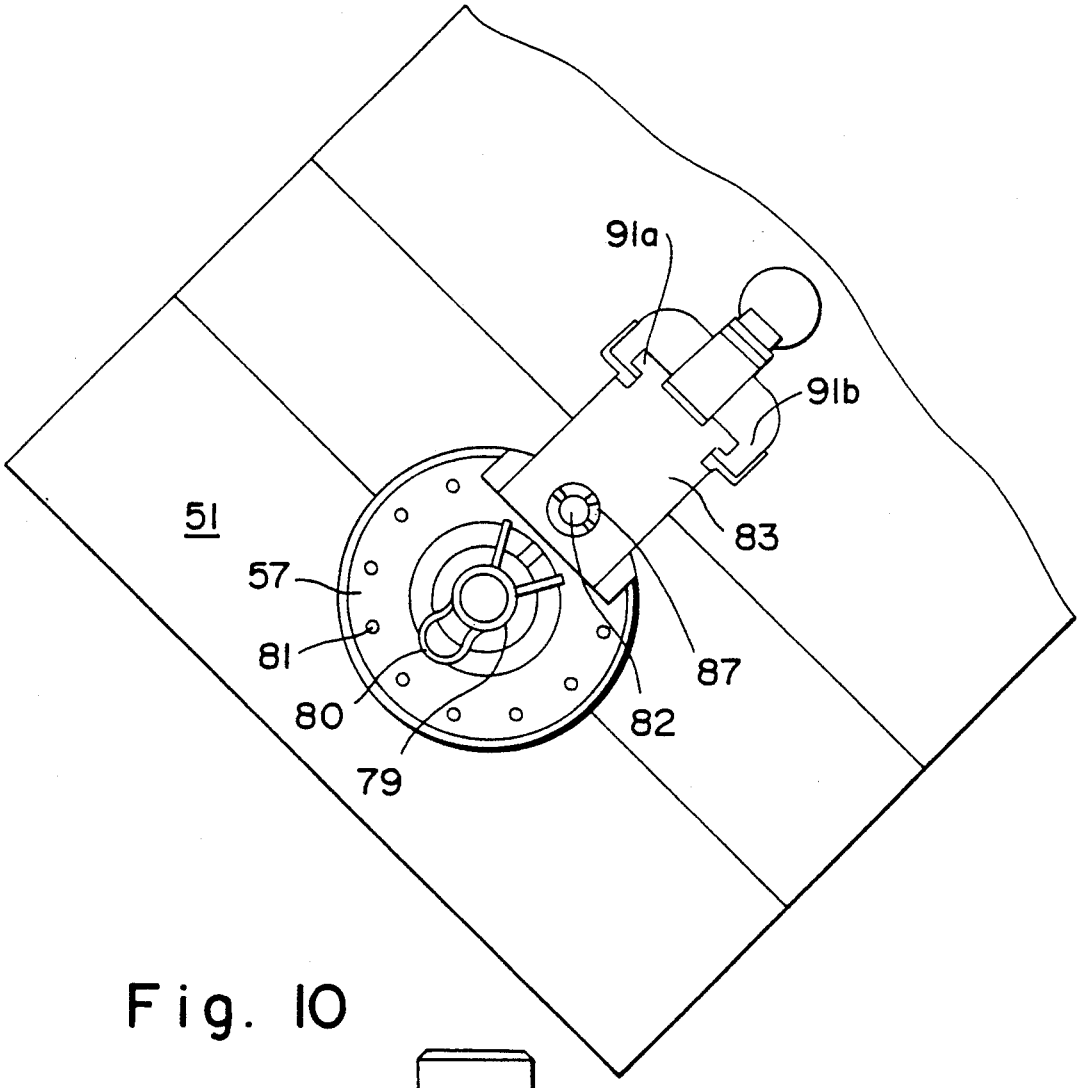
Fig. 9 PRIOR ART
FIG. 9 represents the FR '451 feed device seen along F of FIG. 7.
Figure 10:
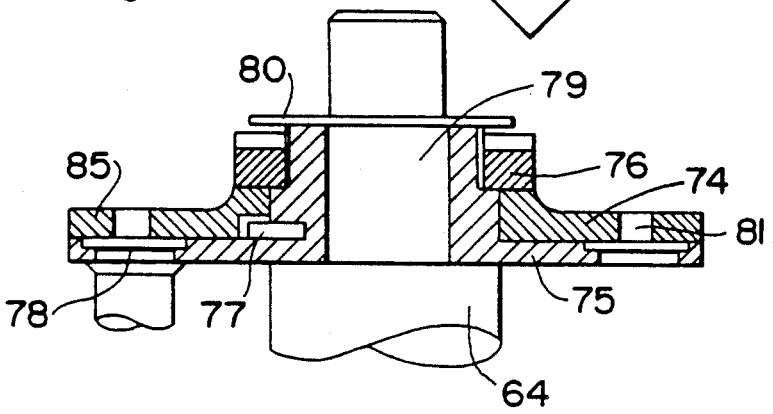
FIG. 10 represents a detailed view of the FR '451 detonator-support along a section passing through its axis.
Figure 12:
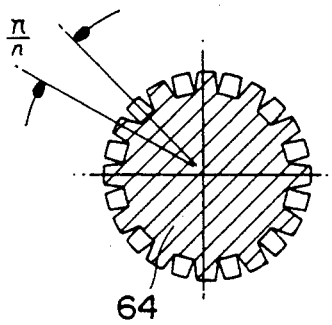
Fig. 12 PRIOR ART
FIG. 12 represents a cross section along I—I of FIG. 11.
Figure 11:
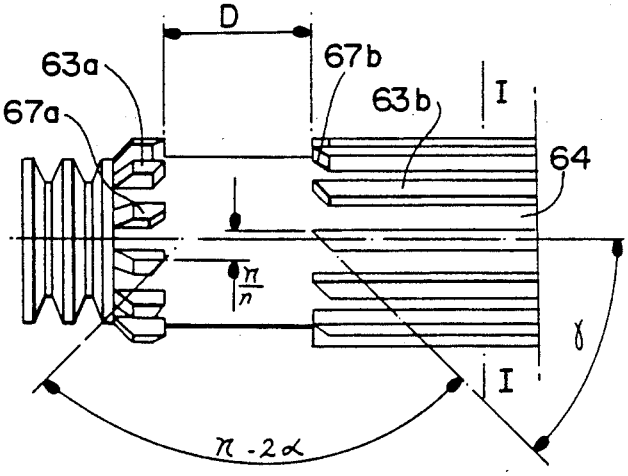
Fig. 11 PRIOR ART
FIG. 11 represents a longitudinal part of the grooved shaft and the circular rack of FR '451.
Figure 14:
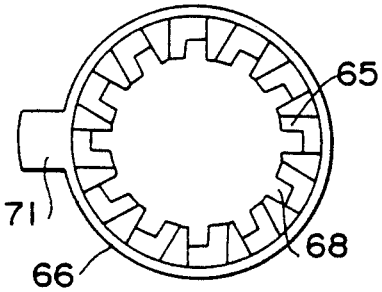
Fig. 14 PRIOR ART
FIG. 14 represents the grooved ring seen along V of FIG. 13, FIGS. 15 and 16 represent developed views of the grooved shaft-grooved ring assembly of FR '451.
Figure 13:
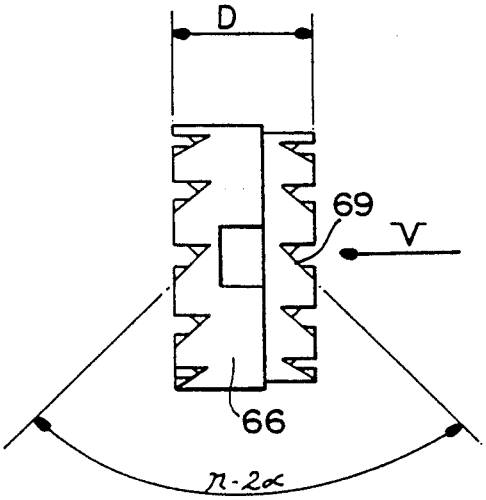
Fig. 13 PRIOR ART
FIG. 13 represents an external detailed view of the grooved ring of FR '451.
Figure 15:
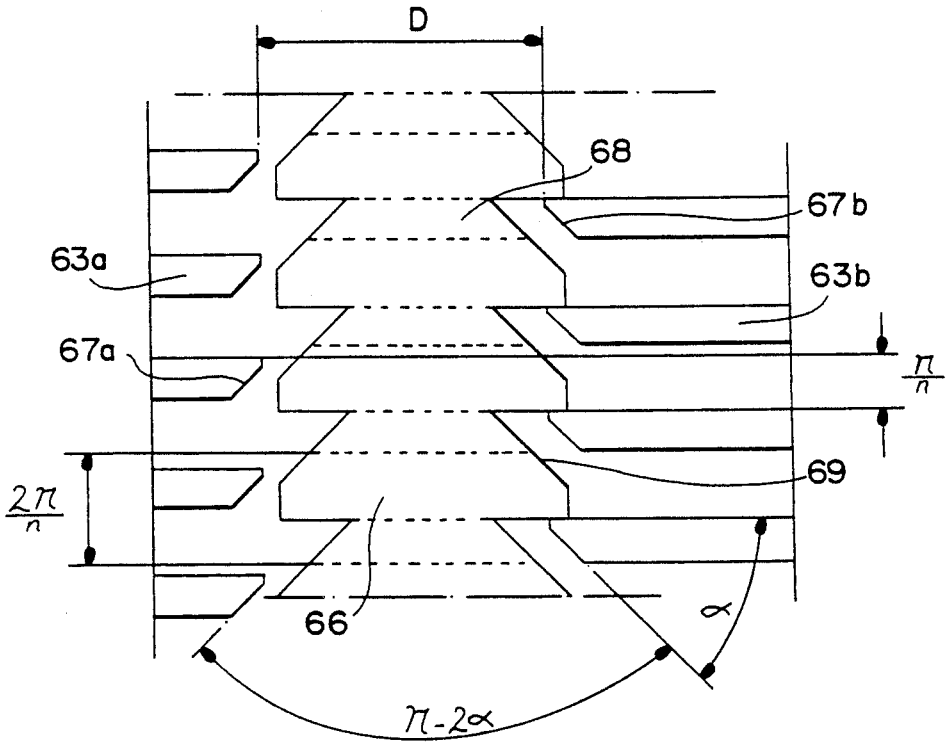
Fig. 15 PRIOR ART
Figure 16:
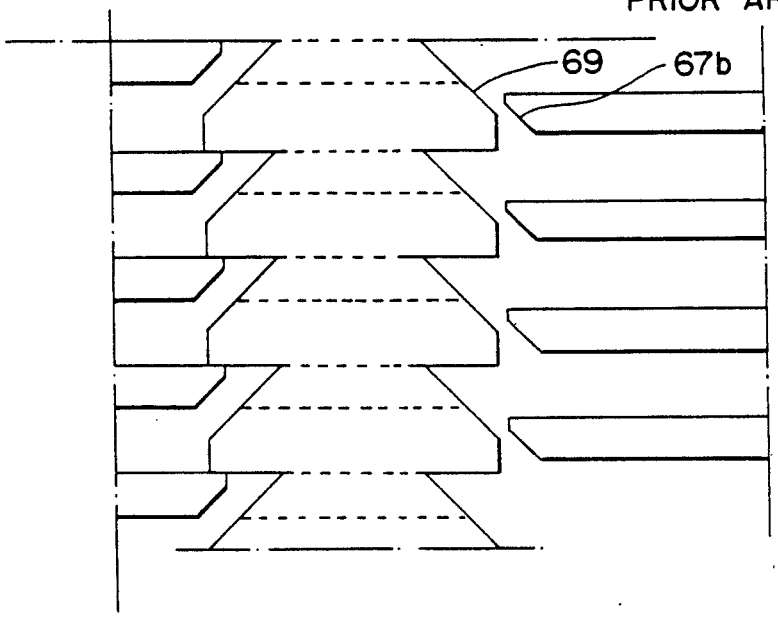
Fig. 16 PRIOR ART

As the motion of lever 15 continues as shown in 15*b* of FIG. 4*b*, the roller 19 continues its travel in the groove 24 while the roller 20 engages in the part 23 of the Z-shaped groove on the breech wedge 1. The result is that this breech wedge moves in the direction of the arrow F4 to close the breech. This closing is completed when the lever 15 reaches its position 15*c*, shown in FIG. 4*b*, while the breech wedge 1 is then located in the position shown in FIGS. 7 and 2, with respect to the breech sleeve 2.

During this second phase of motion, the stops 34 and 35 have come into contact, so that the slider 25, which initially was located in position 25' (shown in mixed lines in FIG. 1) with respect to the breech wedge 1 has arrived at its solid-like position with the pin 27 having its upper part facing the chamber 6 and its lower part facing the actuating component 38. During this same motion, the head of the rod 41 has come up opposite a firing element mounted on the breech wedge 2, so that the firing system is aligned.

If, in this position, an impact is exerted on the rod 41 in the direction of the arrow F5, this rod drives against the action of spring 42, thereby causing the shaft 40 to rotate along with actuating element 38. This flips the pin 27, which causes the primer to detonate, and hence the propulsive charge.

It will be noted that the forward end of the primer is crimped into the tapered end of the chamber 6 because of the cooperation of an inclined surface 44 on slider 25 with an inclined surface 45 on primer-cartridge magazine 4. As the inclined surface 44 of slider 25 comes to bear on the inclined surface 45 on the primer-cartridge magazine 4, the primer-cartridge magazine 4 crimps the primer into the conical portion of the primer housing 6. Because the rack 9 is fixed in relation to the primer-cartridge magazine 4, this motion causes rack 9 to move in the direction of the crimping, thus resulting in the rotation of pinion 8. Because fork 12 prevents the other end of shaft 10 from moving, the rotation of pinion 8 cause shaft 10 to twist. The resulting elasticity aids in the removal of the primer cartridge after firing.

After the shot is fired, the lever 15 is first returned to its position 15*b*, which causes the breech wedge 1 to move in the direction of the arrow F6 in FIG. 1.

Because of the friction forces, the rod 32 slides in the bore 33, thereby driving the slider 25 with the breech wedge 1. When its stop surface 36 comes into contact with the stop surface 37 of the breech sleeve 2, the slider 25 is immobilized with respect to this sleeve so that, with the breech wedge continuing its motion in the direction of the arrow F6, the slider 25 is returned to its position 25' with respect to this breech wedge.

It will be noted that, as soon as the breech wedge begins to move, the firing system alignment is broken because of the lateral displacement of the rod 41. As soon as the stop surfaces 36 and 37 are in contact, the firing system alignment is broken a second time by the fact that the lower part of the pin 27 is no longer opposite the actuating element 38.

When the opening motion of the breech wedge 1 is finished, the lever 15 causes the fork 12 to move in the reverse direction of arrow F2 and, by a reverse motion to the one described above, causes the primer-cartridge magazine to be extracted and rotated. As the fork 12 moves in the reverse direction of F2, it causes pinion 11 and thus pinion 8 to move in the reverse direction of F3. As described in the above mentioned French patent No. A 2,464,451 the rotation of pinion 8 induces a translational motion upon rack 9 causing the primer to be removed from the casing and resulting in rotation of the primer-cartridge magazine 4.

Any and all modifications, variations or equivalent arrangements which may occur to those skilled in the art should be considered within the scope of the invention as defined in the appended claims.

We claim:

1. A mechanism for controlling a primer-cartridge magazine, said magazine exhibiting both translation and rotation and being mounted in an artillery cannon breech wedge which slides in relation to a breech sleeve, said mechanism comprising: a fork which slides in relation to the breech wedge under control of a lever, said fork having a portion forming a rack and communicating with a first pinion, said first pinion being mounted on a shaft which supports a second pinion communicating with a second rack, and the second rack controlling the translation and rotation of said magazine.

2. The mechanism of claim 1 wherein said lever at one end is mounted on the breech sleeve and is pivotable in relation to the breech sleeve, said lever at an other end having two rollers mounted on opposite sides of the lever, one roller communicating with a groove in the fork so as to cause the fork to slide in relation to the breech wedge, and the other roller communicating with a groove in the breech wedge so as to cause the breech wedge to slide in relation to the breech sleeve.

3. The mechanism of claim 2, wherein the grooves in the fork and the breech wedge are superposed when the breech wedge slides in relation to the breech sleeve.

4. The mechanism of claim 2, wherein the groove is located in surface of the breech wedge and includes a circular part centered on said lever's axis of rotation, so that said lever does not cause the breech wedge to move during the rotation of the primer-cartridge magazine.

5. The mechanism of claim 1 wherein the mechanism includes a slider carrying a pin and sliding on the wedge between a first position where the pin is facing a primer to be fired and a second position where the slider frees the primer-cartridge magazine, with stops being provided on the breech sleeve to move the slider with respect to the wedge when the wedge moves with respect to the sleeve.

6. The mechanism of claim 5, wherein said slider is attached to a rod sliding in a bore of the breech sleeve, a stop of the rod cooperating with a stop of the breech sleeve to bring the slider into its said first position when the breech wedge is closed, and a stop on the slider cooperating with a stop on the sleeve to bring the slider into its said second position when the breech wedge is open.

7. The mechanism of claim 5 wherein said slider includes an inclined surface arranged to cooperate with a corresponding surface on the primer-cartridge magazine to crimp the primer into its lodging, while a resulting translational motion for said second rack is absorbed by a torsion prestress of the shaft supporting said first and second pinions.

8. The mechanism of claim 5, wherein the mechanism includes a pin actuating element mounted to pivot on the wedge at a position such that the pin may only be actuated when the slider is in its first said position.

* * * * *